US005688428A

United States Patent [19]

Maguire

[11] Patent Number: 5,688,428

[45] Date of Patent: Nov. 18, 1997

[54] HOLDER FOR VERTICAL STEEL REBAR

[76] Inventor: Joe Maguire, 1865 261st St., Lomita, Calif. 90717-3306

[21] Appl. No.: 614,970

[22] Filed: Mar. 11, 1996

[51] Int. Cl.[6] ..... E04G 17/00

[52] U.S. Cl. ..... 249/91; 52/677; 249/93; 249/219.1

[58] Field of Search ..... 249/91, 94, 93, 249/177, 219.1; 264/35; 52/295, 677, 699

[56] References Cited

U.S. PATENT DOCUMENTS

| | | | |
|---|---|---|---|
| 2,017,553 | 10/1935 | Troiel | 249/93 |
| 3,912,218 | 10/1975 | Lister | 249/93 |
| 3,964,219 | 6/1976 | Hala | 249/93 |
| 4,640,063 | 2/1987 | Ayala | 249/219.1 |
| 4,748,785 | 6/1988 | Wheeler | 249/219.1 |
| 5,125,619 | 6/1992 | Collins | 249/93 |
| 5,337,534 | 8/1994 | Nasca | 249/93 |
| 5,388,804 | 2/1995 | Cohen et al. | 249/93 |

FOREIGN PATENT DOCUMENTS

| | | | |
|---|---|---|---|
| 153597 | 2/1956 | Sweden | 249/93 |

*Primary Examiner*—Jay H. Woo
*Assistant Examiner*—Joseph Leyson
*Attorney, Agent, or Firm*—Irving Keschner

[57] ABSTRACT

A member having first and second vertically extending leg portions, and a base member connecting one end of each leg member, a wood beam for the concrete structure being positioned in the channel formed between the first and second leg portions. A plurality of cup shaped members are formed along the outside surface of the first leg portion, in one embodiment, and along the outside surface of both leg portions in a second embodiment, vertical steel rebars being positioned in selected one of the cup shaped members. Holes may be formed in the base member to receive fasteners to secure the member to the underlying wood frame member. Protrusions are provided on the bottom surface of the base member thus providing a space between the surface and adjacent top surface of said wood frame member to enable the device to be removed after the concrete sets.

8 Claims, 2 Drawing Sheets

HOLDER FOR VERTICAL STEEL REBAR

BACKGROUND OF THE INVENTION

1. Field of the Invention

The present invention provides a device for supporting vertical steel rebar of various diameters during the pouring of a concrete structure.

2. Description of the Prior Art

In typical construction projects which require concrete structures, such as foundations, vertical extending steel rebar is necessary to strengthen the structure.

In order to hold the rebar in position during the pouring of the concrete, the prior art typically utilized steel tie wires connecting the rebar to an underlying wood frame member. In essence, the tie wire is coupled to the rebar at one end and the wood frame at the other. After the concrete sets, the wood frame is removed from the adjacent concrete structure. Although the use of tie wires provides a simple technique for positioning the rebar, it requires a person to hold the rebar during the tying operation. In addition, the rebar often does not maintain a proper vertical orientation during the concrete pouring stage. Finally, wire cutters are needed to cut the tie wire in order to remove the wood frame after the concrete sets.

An improved vertical rebar positioning device is a hook and clamp type device manufactured by Precision Builders, Redding, Calif. The hook portion of this device fits about the rebar, the clamp portion being secured to the wood frame. Although providing advantages over the commonly used tie wires, it has a serious disadvantages in that it is costly and difficult to remove the wood frame member after the concrete sets.

What is thus desired is to provide an improved device for positioning vertical steel rebar which is less expensive than those available in the prior art and wherein the installation time required for the vertical steel rebar is reduced, thus reducing labor costs.

SUMMARY OF THE PRESENT INVENTION

The present invention provides a member having first and second vertically extending leg portions, and a base member connecting one end of each leg member, a wood frame member for the concrete structure being positioned in the channel formed between the first and second leg portions. A plurality of cup shaped members are formed along the outside surface of the first leg portion, in one embodiment, and along the outside surface of both leg portions in a second embodiment, vertical steel rebars being positioned in selected one of said cup shaped members. Holes may be formed in the base member to receive fasteners to secure the member to the underlying wood frame member. In a preferred embodiment, protrusions are provided on the bottom surface of the base member to provide a space between the surface and the adjacent top surface of the wood frame member to enable the device to be removed after the concrete sets.

The present invention thus provides a relatively inexpensive vertical steel rebar placement device which has the capability of supporting rebar of various diameters and wherein the device can be easily removed after the concrete is poured and sets.

BRIEF DESCRIPTION OF THE DRAWING

For a better understanding of the invention, as well as other objects and further features thereof, reference is made to the following description which is to be read in conjunction with the accompanying drawing wherein.

DESCRIPTION OF THE INVENTION

Figure 1:
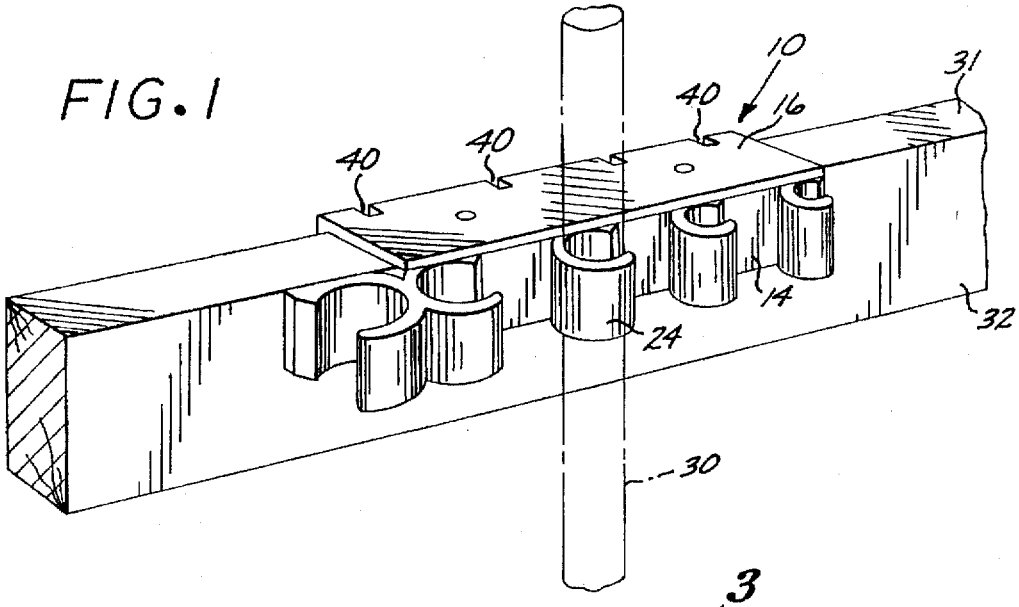
FIG. 1 is a perspective view of the device of the present invention installed on a wooden beam.
Figure 2:
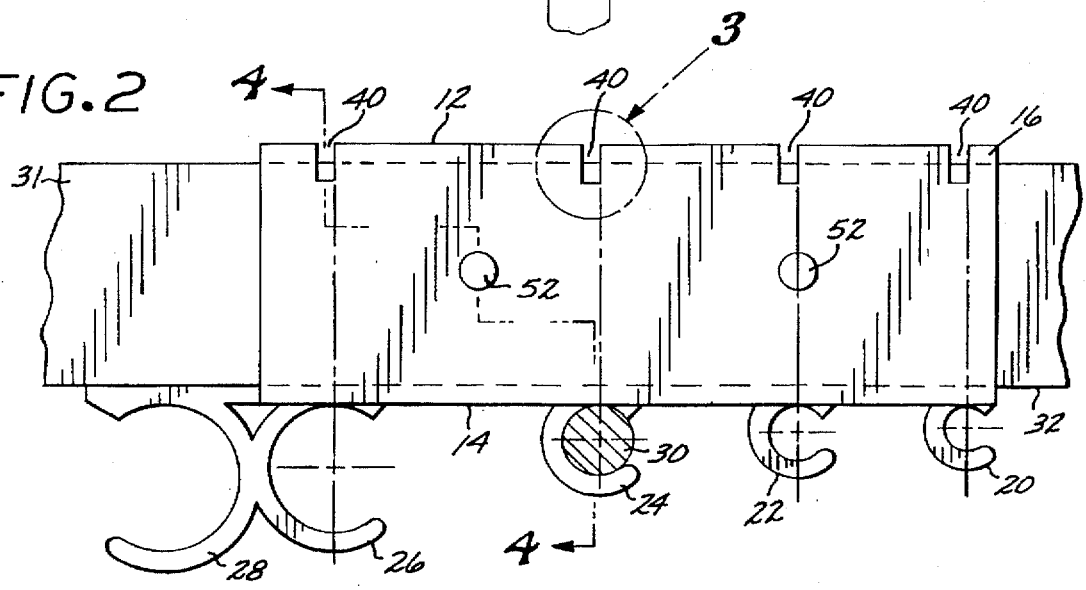
FIG. 2 is a top plan view of the device shown in FIG. 1.

Referring now to FIGS. 1–4, a first embodiment of the vertical steel rebar holding device 10 of the present invention is illustrated. Device 10, preferably made of plastic, comprises a U-shaped member having leg portions 12 and 14 joined by base member 16 and a plurality of cup shaped members 20, 22, 24, 26, and 28 integral with the outside surface of said wall 14 as illustrated. The cup shaped members are essentially cylindrical in shape and have an extended longitudinal slot formed along the entire length thereof as illustrated. The internal diameter of the shaped members are varied and selected to correspond to the outside diameters of various steel rebars. In the example illustrated, cup shaped member 24 has an internal diameter of approximately 0.5 inches and is sized to frictionally engage the vertical steel rebar 30 and hold the rebar in place during the concrete pouring operation. The length of device 10, along its longitudinal dimension, is variable, typically in range from about 4 inches to about 6 inches inches and is selected to enable the designed number of steel rebars to be utilized for a particular project (note that only one rebar member is used for each device 10). As illustrated, device 10 is positioned over wooden frame member 32 in a manner such that inner surface 34 of base member 16 is in contact with frame member 32.

Figure 3:
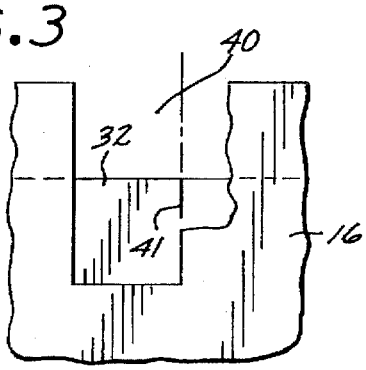
FIG. 3 is a detail of a portion of FIG. 2.
Figure 4:
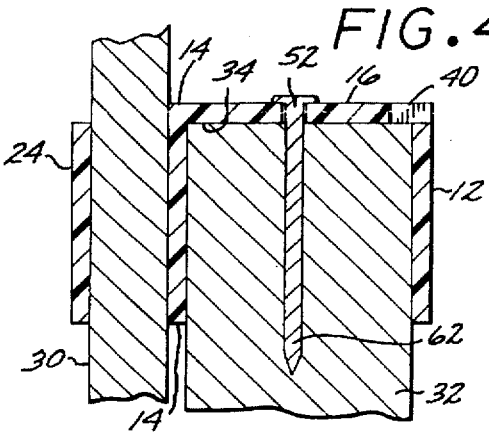
FIG. 4 is a cross-sectional view along line 4—4 of FIG. 3.
Figure 5:
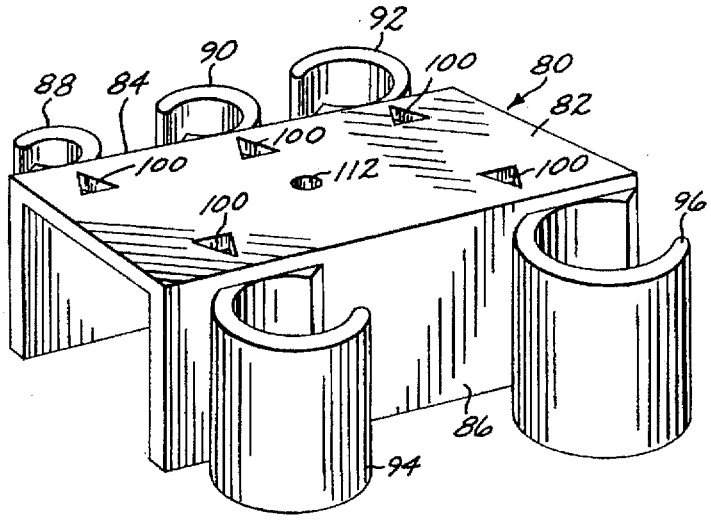
FIG. 5 is a perspective view of a second embodiment of the present invention installed on a beam.

A plurality of notches 40 are formed inside wall 12 and provide a window to enable the user of device 10 to see rebar placement marks (the cutaway of FIG. 3 shows a mark 41) formed on surface 31 of member 32. A plurality of holes, or apertures, 52 are formed in base member 16 and fasteners, such as nails, 62 are positioned therethrough as illustrated in FIG. 4 to secure device 10 to frame member 32.

In operation, after the wood framing is constructed, device 10 is positioned over the top edge thereof in the manner shown in FIG. 1. Fasteners are then inserted through holes 52 into the surface 31 of frame member 32. Steel rebar is then positioned into selected members 22 and thereafter the concrete is poured. It should be noted that the height of device 10 is selected, in conjunction with the height of wood frame member 32, so that the level of the concrete is below the bottom surface of the cup shaped members. In essence, the device 10 is not embedded in the concrete after the concrete sets. After the concrete sets, device 10 is removed from frame member by first removing fasteners 62 and then using the claw portion of a hammer to remove device 10 and then hitting the side of wooden member 32 so that the wooden member slides free from the adjacent set concrete.

FIGS. 5 through 8 illustrate a second embodiment of the present invention. In particular, device 80 comprises a U-shaped member having a base portion 82 and leg portions 84 and 86. A plurality of cylindrically shaped cup holder members 88, 90, 92, 94, and 96 each having a longitudinal slot formed along the length thereof are integrally connected to the exterior surface of the leg portions. In the embodiment illustrated, members 88, 90 and 92 are integral with leg portion 84 and members 94 and 96 are integral with leg portion 86. It should be noted that the number of holder members can vary from the five illustrated, depending upon the standard diameter of the rebar utilized in the industry. Vertical rebar 98 is positioned in holder 90 as illustrated, rebar 98 being frictionally engaged and held by the holder 90. Only one rebar member is utilized with each device 80.

Figure 6:
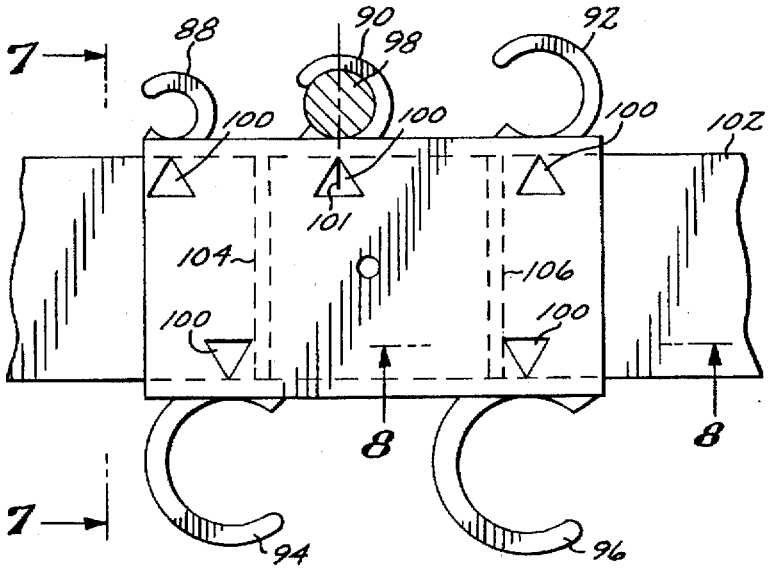
FIG. 6 is a top plan view of the device shown in FIG. 5.
Figure 7:
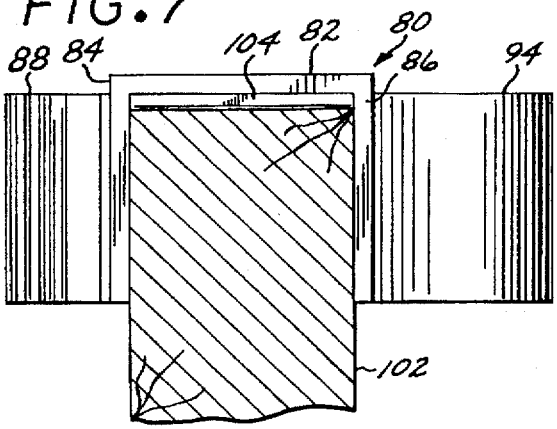
FIG. 7 is a cross-sectional view along line 7—7 of FIG. 6.
Figure 8:
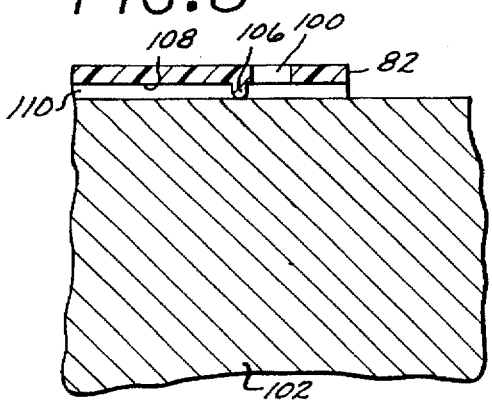
FIG. 8 is a cross-sectional view along line 8—8 of FIG. 6.

A plurality of triangular shaped see-through apertures 100 are formed in base portion 82 enabling user to look for markings formed in the upper surface of wood frame member 102 and accurately position device 80 thereover (FIG. 6 shows mark 101). A pair of protrusions 104 and 106 are formed in the lower surface 108 of base member 82 to provide a space 110 between surface 108 and the adjacent surface of frame member 102 (note that protrusions can also be utilized with the embodiment shown in FIGS. 1–4). An aperture 112 is provided in base member 82 to allow a fastener to pass therethrough and secure device 80 to frame member 102.

Device 80 is preferably made of plastic and molded in a manner such that base member 82, leg portions 86 and 84, holder members 88, 90, 92, 94, and 96 and protrusions 104 and 106 are integral.

After the concrete sets, device 80 is removed from frame member 102 by first removing the fastener and using the claw portion of a hammer in space 110 to pry off the device from the rebar. The frame member 102 is then removed by hitting it from the side with a hammer or other instrument so that it slides free from the adjacent set concrete. Alternatively, device 80 can be hit in the direction facing the open portion of the cup member 90, thus causing the device to slide off frame member 102. A plurality of devices 80 are typically utilized in a construction project (the same is true for the embodiment shown in FIGS. 1–4).

The present invention thus provides a device for accurately positioning vertical rebar used in conjunction with concrete construction which is relatively inexpensive and wherein the wood frame member is easily removed after the concrete sets.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teaching of the invention without departing from its essential teachings.

What is claimed is:

1. A device for supporting vertical rebar in preparation for pouring concrete into an area framed by a wooden frame member, said device having a vertical axis and being adapted to be positioned on said frame member comprising:

a U-shaped member comprising a base member and first and second leg portions vertically extending to said base member to join said first and second portions, a channel area for receiving the wooden frame member being formed between said joined leg portions, said first and second leg portions having exterior surfaces; and a first set of vertically elongated holding members extending from the exterior surface of said first leg portion, each of said holding members frictionally engaging and holding vertical rebar of a predetermined outside diameter inserted therein, said first set of elongated members extending and spaced horizontally along said first leg portion.

2. The device of claim 1 wherein a second set of vertically elongated holding members extends from the exterior surface of said second leg portion, said second set of elongated members extending and spaced horizontally along said second leg portion.

3. The device of claim 1 wherein at least one protrusion extends from a bottom surface of said base member whereby a space is provided between said bottom surface and the top surface of said frame member when said device is positioned thereon.

4. The device of claim 1 wherein at least one fastener receiving aperture is formed in said base member.

5. The device of claim 1 wherein at least one aperture is formed in said base member to enable a user to view markings formed on a top surface of said frame member.

6. The device of claim 1 wherein said holding members are integral with a surface of said first leg portion.

7. The device of claim 1 wherein said device is fabricated from plastic.

8. The device of claim 1 wherein said elongated holding members engage a portion of the circumference of said vertical rebar inserted therein.

* * * * *